US007237564B1

(12) United States Patent
Anderson et al.

(10) Patent No.: US 7,237,564 B1
(45) Date of Patent: Jul. 3, 2007

(54) DISTRIBUTION OF ENERGY IN A HIGH FREQUENCY RESONATING WAFER PROCESSING SYSTEM

(75) Inventors: Tom Anderson, Livermore, CA (US); John M. Boyd, Atascadero, CA (US)

(73) Assignee: Lam Research Corporation, Fremont, CA (US)

( * ) Notice: Subject to any disclaimer, the term of this patent is extended or adjusted under 35 U.S.C. 154(b) by 285 days.

(21) Appl. No.: 10/371,679

(22) Filed: Feb. 20, 2003

(51) Int. Cl.
*B08B 3/00* (2006.01)
*B06B 1/06* (2006.01)

(52) U.S. Cl. ..... 134/184; 134/137; 134/147; 134/902; 310/367; 367/140; 367/141; 367/153; 367/154; 367/155; 367/157; 367/166

(58) Field of Classification Search ..... 134/1, 134/1.3, 104.1, 137, 147, 902, 199, 184, 134/186; 367/140, 141, 153–155, 157, 166; 310/328, 367, 368
See application file for complete search history.

(56) References Cited

U.S. PATENT DOCUMENTS 2,406,792 A * 9/1946 Benioff ..... 367/163
2,466,112 A * 4/1949 Keller ..... 367/157
2,484,626 A * 10/1949 Keller ..... 367/155
2,497,680 A * 2/1950 Massa ..... 367/152
3,371,233 A 2/1968 Cook
3,470,394 A * 9/1969 Whatley, Jr. et al. ..... 310/334
3,788,721 A * 1/1974 Vause ..... 445/27
4,118,649 A * 10/1978 Shwartzman et al. ..... 310/337
4,270,105 A * 5/1981 Parker et al. ..... 333/155
4,692,654 A * 9/1987 Umemura et al. ..... 310/334
4,736,759 A * 4/1988 Coberly et al. ..... 134/66
4,909,266 A 3/1990 Massa
5,260,913 A * 11/1993 Kadota et al. ..... 367/140
5,316,591 A 5/1994 Chao et al.
5,370,740 A 12/1994 Chao et al.
5,377,705 A 1/1995 Smith et al.
5,446,330 A * 8/1995 Eda et al. ..... 310/313 R
5,456,759 A 10/1995 Stanford et al.
5,522,938 A 6/1996 O'Brien
5,698,040 A * 12/1997 Guldi et al. ..... 134/1.3
6,671,380 B2 * 12/2003 Chang et al. ..... 381/190
6,711,792 B2 * 3/2004 Itasaka ..... 29/25.35
6,713,389 B2 * 3/2004 Speakman ..... 438/674
6,726,848 B2 * 4/2004 Hansen et al. ..... 216/109
6,840,250 B2 * 1/2005 Kashkoush et al. ..... 134/1.3
6,870,306 B2 * 3/2005 Ajioka ..... 310/367
6,880,560 B2 * 4/2005 Ching et al. ..... 134/1.3
6,954,021 B2 10/2005 Gouk et al.

* cited by examiner

*Primary Examiner*—Michael Barr
*Assistant Examiner*—Sarah E. Husband
(74) *Attorney, Agent, or Firm*—Martine Penilla & Gencarella, LLP

(57) ABSTRACT

A transducer for use in an acoustic energy cleaner is provided. The transducer includes a resonator and a plurality of crystals bonded to a surface of the resonator. The plurality of crystals is configured to be bonded to the surface of the resonator in a staggered arrangement with respect to each other. In one embodiment, the plurality of crystals is bonded to the surface of the resonator in a horizontally staggered arrangement. In another embodiment, the plurality of crystals is bonded to the surface of the resonator in a vertically staggered arrangement.

14 Claims, 16 Drawing Sheets

DISTRIBUTION OF ENERGY IN A HIGH FREQUENCY RESONATING WAFER PROCESSING SYSTEM

BACKGROUND OF THE INVENTION

1. Field of the Invention

The present invention relates generally to substrate surface cleaning and, more particularly, to a method and apparatus for improving high frequency acoustic energy cleaning of a semiconductor substrate following fabrication processes.

2. Description of the Related Art

As is well known, megasonic cleaning is widely used in semiconductor manufacturing operations and can be implemented in a batch cleaning process or a single wafer cleaning process. In a batch cleaning process, the vibrations of a megasonic transducer creates acoustic pressure waves in the liquid medium of a cleaning tank containing a plurality of semiconductor substrates. Normally, in megasonic cleaning of multiple batches of semiconductor substrates in the cleaning tank, the semiconductor substrates are static (i.e., stationary) allowing multiple reflections of the acoustic energy to be averaged, using the design of the tank and placement of the wafer cassette to minimize energy 'dead zones' or energy 'hot spots'. Hot spots (i.e., high energy regions) are caused due to constructive interference of megasonic wave reflections from both the multiple wafers and the megasonic tank walls while cold spots (i.e., low energy regions) are caused due to destructive interference of same.

In a single wafer megasonic cleaner, however, a small transducer is defined above a rotating wafer, wherein the transducer scans across the rotating wafer using a fluid meniscus coupling. Alternatively, in the case of full immersion of the semiconductor wafer in a single wafer tank system, the acoustic energy is typically transmitted to and through the liquid medium to the semiconductor wafer.

FIG. 1A is a simplified top view of a megasonic transducer 10, in accordance with the prior art. The megasonic transducer is fabricated using a plurality of crystals 14*a*–14*d* of piezoelectric material bonded to a resonator 12. The crystals 14*a*–14*d* are shown to be bonded to the resonator such that a gap exists between each pair of adjacent crystals. The acoustic energy imparted by the transducer 10 is averaged as a result of the rotation of the semiconductor substrate about the transducer 10.

The performance of the transducer is determined by the material properties of the piezoelectric crystals as well as the bonding method of the crystals 14*a*–14*d* to the resonator 12. Currently, high and low energy zones are created radially across the semiconductor substrate during the megasonic cleaning, resulting in variations in cleaning efficiency as well as radially dependent damage across the semiconductor substrate if the peaks in energy are above the damage threshold.

One of the primary causes of variation in cleaning efficiency is the existence of the gap regions 46 defined between each pair of adjacent crystals 14*a*–14*d*. Specifically, each gap region 46 creates a zero-energy zone, which in turn, forms a band of defects at a specific radius of the semiconductor wafer. The bands of defects each corresponding to a gap region 46 is one of the primary sources of having non-or minimal cleaning in the zero energy zones.

Creation of bands of defects at specific radii is shown in FIG. 1B, in accordance with the prior art. Gap regions 46*a* and 46*b* are shown to have been respectively defined between adjacent crystals 14*a*–14*b* and 14*b*–14*c*. The dead energy zones corresponding to the gap regions 46*a* and 46*b* are shown in the average energy versus distance plot, shown in FIG. 1C of the prior art. As can be seen, the high energy zones 16*c*–16*a* correspond to centers 16*a*–16*c* of the crystals 14*a*–14*c*, respectively. While, the dead energy zones 46*a*–46*b* respectively correspond to the gap regions 46*a* and 46*b*. The non-uniform cleaning of the semiconductor substrates resulting from dead-zone banding effect undesirably results in production of defective semiconductor substrates.

One way to avoid the dead zone banding effects generated by array of small crystals is implementing a single piezoelectric crystal 22 bonded to the resonator 12, as shown in FIG. 1D of the prior art. Although implementing the single crystal transducers is beneficial in eliminating the bands of defects, attempting to uniformly bond the single crystal 22 to the resonator 12 is very difficult and challenging. As can be seen, voids 22*a*–22*c* are created between the single crystal 22 and the resonator 12 during the bonding, negatively affecting the performance of the transducer and resulting in non-uniform cleaning. Additionally, bonding the single piezoelectric crystal 22 to the resonator 12 is more costly than bonding a plurality of small crystals.

In view of the foregoing, a need therefore exists in the art for a single wafer cleaning system capable of uniformly distributing acoustic energy on semiconductor substrates being cleaned at a lower cost, while substantially eliminating damaging dead zone band effects.

SUMMARY OF THE INVENTION

Broadly speaking, the present invention fills this need by providing a system for cleaning a single semiconductor substrate using a transducer implementing a plurality of staggered piezoelectric crystals. The piezoelectric crystals bonded to a resonator can be staggered vertically or horizontally, allowing the averaging of sonic energy imparted by the transducer onto the surfaces of the rotating semiconductor substrate. It should be appreciated that the present invention can be implemented in numerous ways, including as a process, an apparatus, a system, a device, or a method. Several inventive embodiments of the present invention are described below.

In one embodiment, a transducer for use in an acoustic energy cleaner is provided. The transducer includes a resonator and a plurality of crystals bonded to a surface of the resonator. The plurality of crystals is configured to be bonded to the surface of the resonator in a staggered arrangement with respect to each other.

In another embodiment, an apparatus for cleaning a semiconductor substrate is provided. The apparatus includes a first transducer for propagating acoustic energy to a first surface of the semiconductor substrate. The first transducer includes a first resonator having a first surface and a second surface and a plurality of crystals bonded to the first surface of the resonator. The plurality of crystals is configured to be bonded to the first surface of the first resonator in a staggered arrangement with respect to each other.

In yet another embodiment, a method for making an acoustic energy transducer for semiconductor substrate cleaning. The method includes providing a resonator and providing a plurality of crystals. The method also includes bonding the plurality of crystals to a top surface of the resonator in a staggered arrangement with respect to each other.

The advantages of the present invention are numerous. Most notably, the embodiments of the present invention eliminate and reduce dead zone banding effect across the semiconductor substrate surfaces resulting from the gaps defined between the prior art crystals. Another advantage of the present invention is that the transducer of the claimed invention can be implemented in cleaning static (i.e. still) or dynamic (i.e., moving) semiconductor wafers. Yet another advantage of the present invention is that the embodiments of the present invention reduce variation in energy profile across the staggered crystal arrays thus improving cleaning efficiency across the semiconductor substrate surfaces. Still another advantage is that the crystals of the present invention can be staggered in a planer arrangement or in a multi-dimension arrangement.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

Several exemplary embodiments of the invention will now be described in detail with reference to the accompanying drawings. FIGS. 1A, 1B, 1C, and 1D are discussed above in the "Background of the Invention" section. As used herein, the term "about" refers to a reasonable approximation of the specific range provided, such as 10% of the process range.

The embodiments of the present invention provide an apparatus and a method for cleaning a semiconductor substrate with a high frequency acoustic energy cleaning (herein also referred to as acoustic energy or "AE") device. The AE cleaner device is configured to substantially eliminate dead zone band effects. In one embodiment, a plurality of small piezoelectric crystals is bonded to a resonator in a staggered arrangement, allowing averaging of acoustic energy being imparted to the rotating semiconductor substrate. In one embodiment, the crystals are staggered (herein interchangeably also referred to as interlocking and overlapping) in a planer (i.e., horizontal) arrangement allowing each gap defined between crystals to be overlapped by at least one of the plurality of crystals. In another embodiment, the crystals are staggered in a multi-dimensional (i.e., vertical) arrangement such that at least portions of each pair of crystals overlap so as to reduce or eliminate the dead zone banding effects.

In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1A:
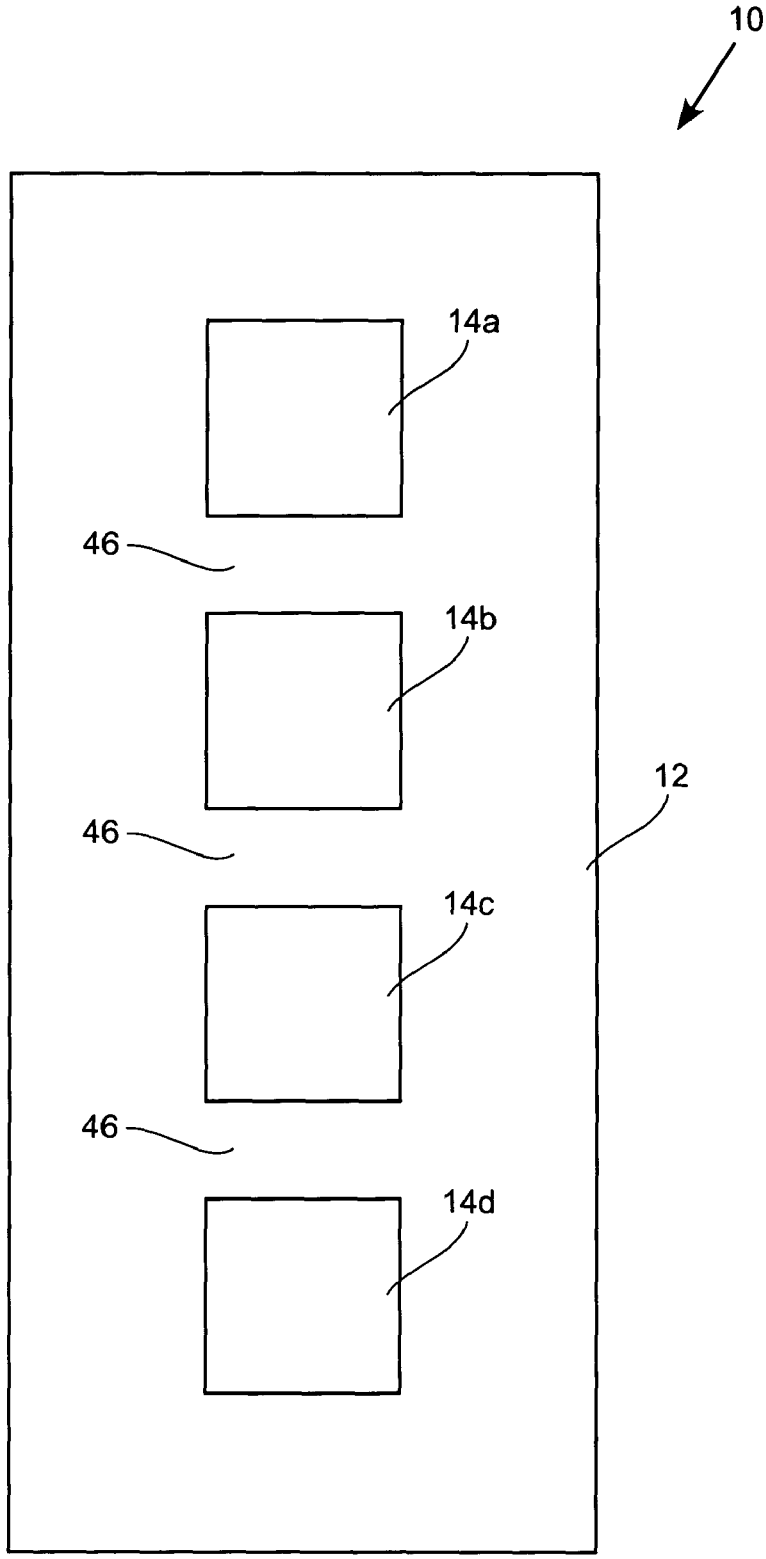
FIG. 1A (Prior Art)
FIG. 1A is a simplified top view of a piezoelectric transducer, in accordance with the prior art.
Figure 1B:
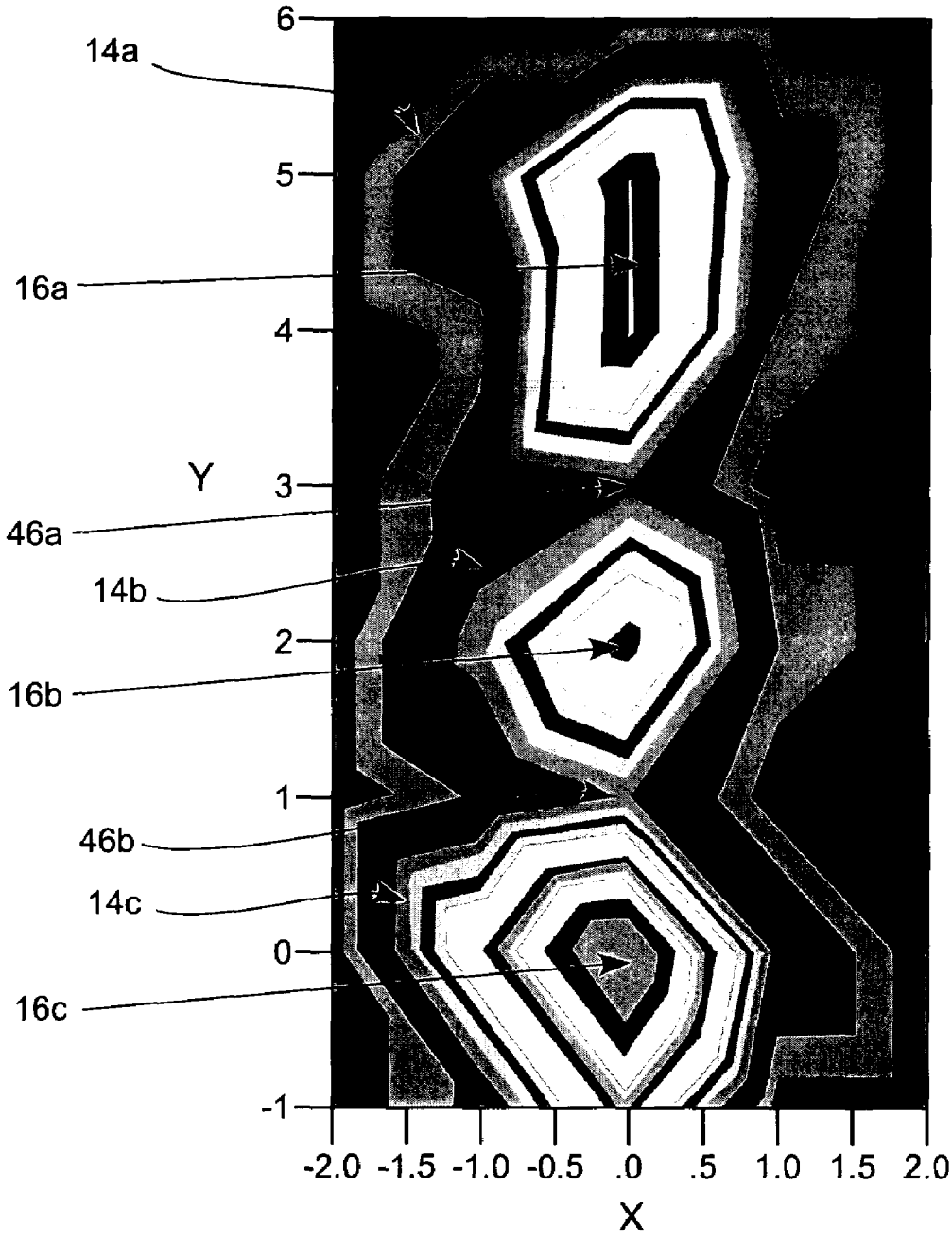
FIG. 1B (Prior Art)
FIG. 1B is a simplified cross sectional view of a plurality of piezoelectric crystals and the associated band of defects, in accordance with the prior art.
Figure 1C:
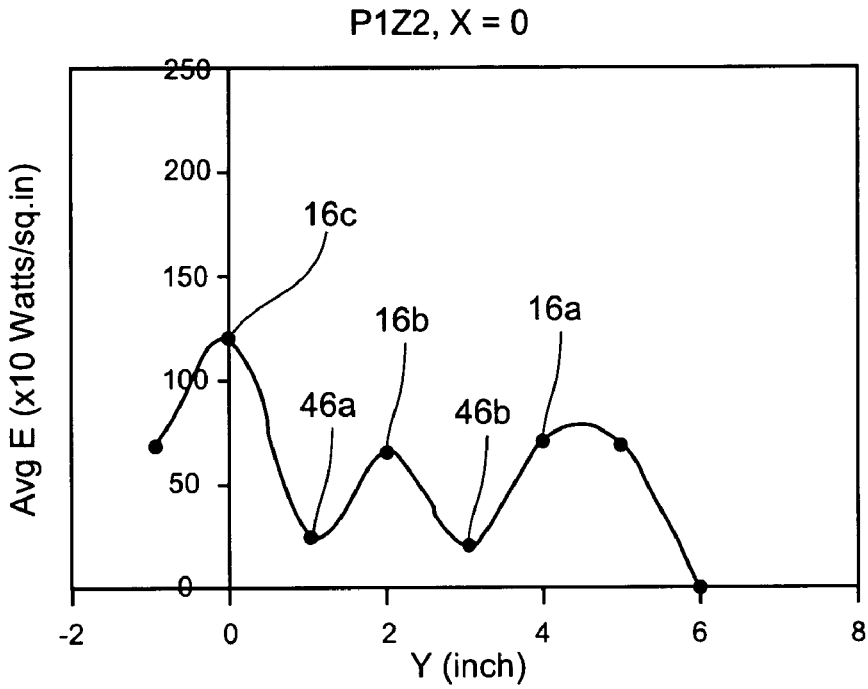
FIG. 1C (Prior Art)
FIG. 1C shows a plot of average acoustic energy versus distance showing the dead energy zones, in accordance with the prior art.
Figure 1D:
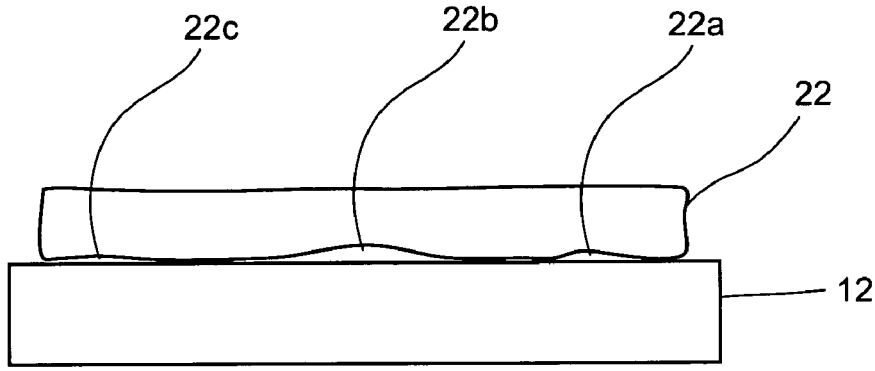
FIG. 1D (Prior Art)
FIG. 1D is a transducer implementing a single piezoelectric crystal, in accordance with the prior art.
Figure 2A:
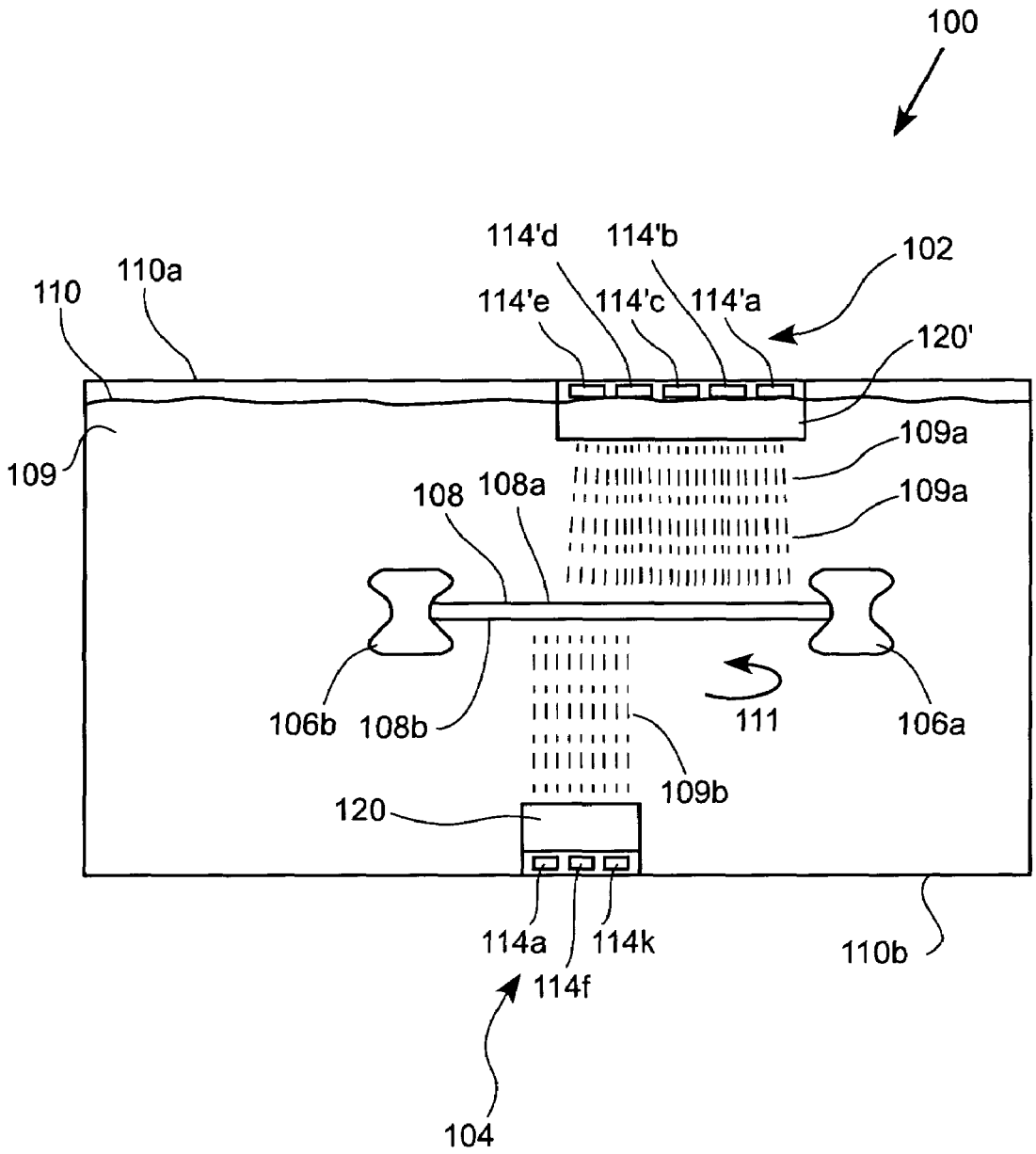
FIG. 2A is a cross sectional view of a single semiconductor substrate high frequency acoustic energy cleaner, in accordance with one embodiment of the present invention.

FIG. 2A is a simplified cross sectional view of an exemplary high frequency acoustic energy cleaner 100, in accordance with one embodiment of the present invention. The high frequency acoustic energy cleaner 100 is shown to include a wafer cleaning tank 110 having a top wall 110*a* and a bottom wall 110*b*. As can be seen, the wafer cleaning tank 110 is substantially filled with a liquid medium, which depending on the embodiment, can be water or a cleaning solution 109. A top transducer 102 and a bottom transducer 104 are respectively defined in the top wall 110*a* and bottom wall 110*b* of the wafer cleaning tank 110. A wafer 108 submerged in the wafer cleaning tank 110 sits on three rollers 106*a*–106*c* (roller 106*c* is not shown in this Figure). In one embodiment, rollers 106*a*–106*c* rotate causing the wafer 108 to rotate in a rotation direction 111.

As can be seen, the top transducer 102 includes a resonator 120' and a plurality of interlocking (herein interchangeably referred to as staggered and overlapping) piezoelectric crystals 114*a*'–114'*e*. The plurality of interlocking crystals 114*a*'–114*e*' are shown to be bonded to the back wall of the resonator 120' as the front wall of the top resonator 120' faces the top surface 108*a* of the wafer 108, as the wafer 108 rotates in the rotation direction 111. In a similar manner, the plurality of crystals 114*a*, 114*f*, and 114*k* are bonded to the back wall of the bottom resonator 120 while the back wall of the bottom resonator 120 faces the wafer backside 108*b*.

As can be appreciated, the top transducer 120' is defined above the wafer 108 such that the length of the top resonator 120' is at least equivalent to a radius of the wafer top surface 108*a*'. In preferred embodiments, however, the length of the top resonator 120' is selected such that the top resonator 120*a*' covers at least partially the center area of the wafer 108. In one embodiment, as can be seen in FIG. 2A, the top resonator 120*a*' is configured to partially cover the rollers 106*a*–106*c*, in an attempt to achieve better high frequency acoustic energy cleaning.

As to the bottom resonator 120, the bottom resonator 120 is defined in the bottom wall 111*b* of the wafer cleaning tank 110 such that the bottom resonator 120 covers at least the radius of the back surface of the wafer 108 as well as at least part of the center of the back side 108*b* of the wafer 108. As can be appreciated, the bottom resonator 120 is defined 90 degrees out of phase with the top resonator 120'. Additionally, the top and bottom resonators 120' and 120 overlap slightly, at least partially, about the center area of the top and bottom surfaces of the wafer 108. In this manner, as will be described in more detail below, the acoustic energy imparted by the 90-degrees out of phase top and bottom resonators 120' and 120 to the top and bottom surfaces 108*a* and 108*b* of the wafer 108 results in substantially uniform removal of unwanted residues and particles therefrom.

In one exemplary embodiment, the vibrations of the top and bottom high frequency acoustic energy transducers 102 and 104 of the high frequency acoustic energy cleaner 100 create sonic pressure waves in the liquid medium 109 in the wafer cleaning tank 110. The top and bottom transducers 102 and 104 defined above or below the rotating wafer 108 scan across the wafer 108 using the liquid medium 109 or alternatively a liquid stream coupling, if the high frequency acoustic energy cleaning is not performed in the wafer cleaning tank 110. In this manner, particles are primarily removed by cavitation and sonic agitation generated in the high frequency acoustic energy cleaner.

The sonic agitation subjects the liquid medium 109 to acoustic energy waves. Under high frequency acoustic energy cleaning, the acoustic energy waves are configured to occur in one embodiment at frequencies between approximately about 0.4 Megahertz (MHz) and about 1.5 MHz, inclusive. In one implementation, the sonic agitation can have a frequency of between approximately about 400 kHz to about 2 MHz. In typical implementations, the megasonic energy ranges typically between approximately about 700 kHz to about 1 MHz. For example, lower frequencies can be used for cleaning applications in the ultrasonic range, which are used mainly for part cleaning. However, preferably, the higher frequencies are used to clean wafers and semiconductor substrates, substantially reducing the possibility of damage to the substrates, which is known to occur at the lower frequencies.

In one embodiment, the top and bottom transducers 102 and 104 create acoustic pressure waves through sonic energy with frequencies approximately about 1 Megahertz. In this manner, acting in concert with the pressure waves, the appropriate liquid medium can be used to control and augment the cleaning action.

As can be seen, top and bottom resonators 120' and 120 extend at least partially past the center of the wafer 108. Sonic energy, such as high frequency acoustic energy, originates from the top and bottom transducers 102 and 104 and is respectively transmitted through top and bottom resonators 120' and 120. Thereafter, the top and bottom resonators 120' and 120 propagate the sonic energy to the top and bottom surfaces 108*a* and 108*b* of the wafer 108. The liquid medium 109 is applied to the surface of wafer 108. The cleaning activity of the liquid medium is enhanced through the cavitation caused by the high frequency acoustic energy applied with the liquid medium 109 to the surface of wafer 108. It should be appreciated that the combination of the high frequency acoustic energy and the liquid medium being applied to the surface of wafer 108 improves wetting and cleaning, especially with respect to high aspect ratio features Additional information with respect to improving the cleaning of wafer surfaces and the high aspect ratio features is provided in U.S. patent application Ser. No. 10/371,603, filed on even date herewith having inventors John M. Boyd, Michael Ravkin, and Fred C. Redeker, and entitled "METHOD AND APPARATUS FOR MEGASONIC CLEANING OF PATTERNED SUBSTRATES." The disclosure of this Application, which is assigned to Lam Research Corporation, the assignee of the subject application, is incorporated herein by reference.

Figure 2B:
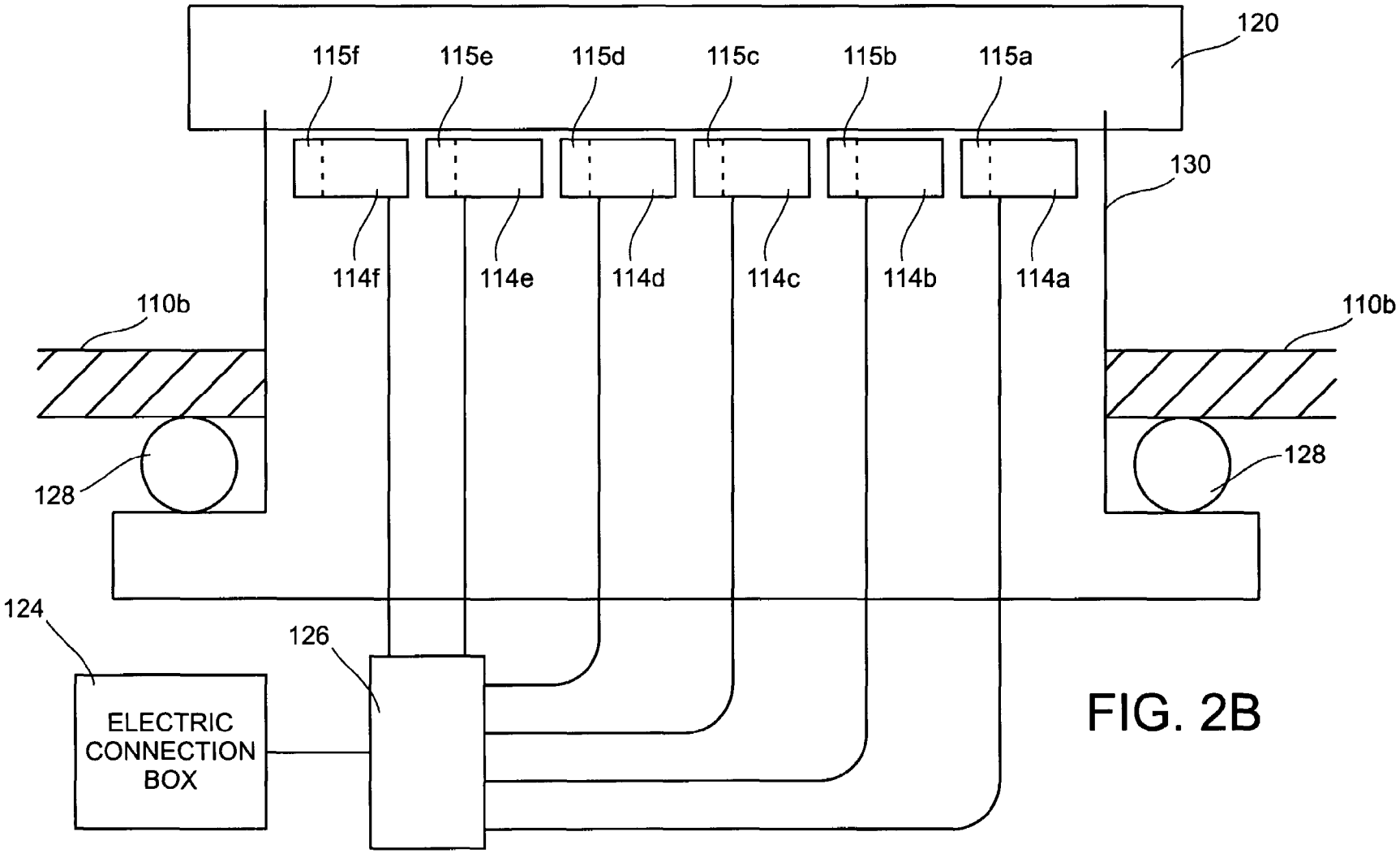
FIG. 2B is an exploded cross sectional diagram of the bottom transducer shown in FIG. 2A, in accordance with one embodiment of the present invention.

Reference is made to the simplified, exploded, cross sectional view in FIG. 2B, depicting the bottom transducer 120 shown in FIG. 2A, in accordance with one embodiment of the present invention. The plurality of interlocking piezoelectric crystals 114*a*–114*f* bonded to the bottom wall of the bottom resonator 120 is defined in a shell 130. The shell 130 is placed in the bottom wall 110*b* of the wafer cleaning tank 110 using the O-ring seal 128. In this manner, the shell 130 protects the crystals 114*a*–114*f* from getting into contact with the liquid medium in the wafer tank.

In the embodiment shown in FIG. 2B, the plurality of crystals 114*a*–114*f* are connected together in parallel. As shown, the crystals 114*a*–114*f* are electrically connected to an electric connection box 124 using box 126. In this manner, the electric connection box 124 can be implemented to drive the crystals 114*a*–114*f* during the high frequency acoustic energy cleaning operation.

As can be seen, respective overlapped portions 115*a*–115*e* can be depicted between each pair of adjacent crystals 114*a*–114*b*, 114*b*–114*c*, 114*d*–114*e*, 114*e*–114*f*, respectively. As will be described in more detail with respect to FIGS. 3A–4D, the transducers of the present invention are configured to implement arrays of staggered crystals so as to eliminate dead zone band effects across the wafer surfaces resulting from the gap regions defined between the crystals of the prior art transducers.

Figure 3A:
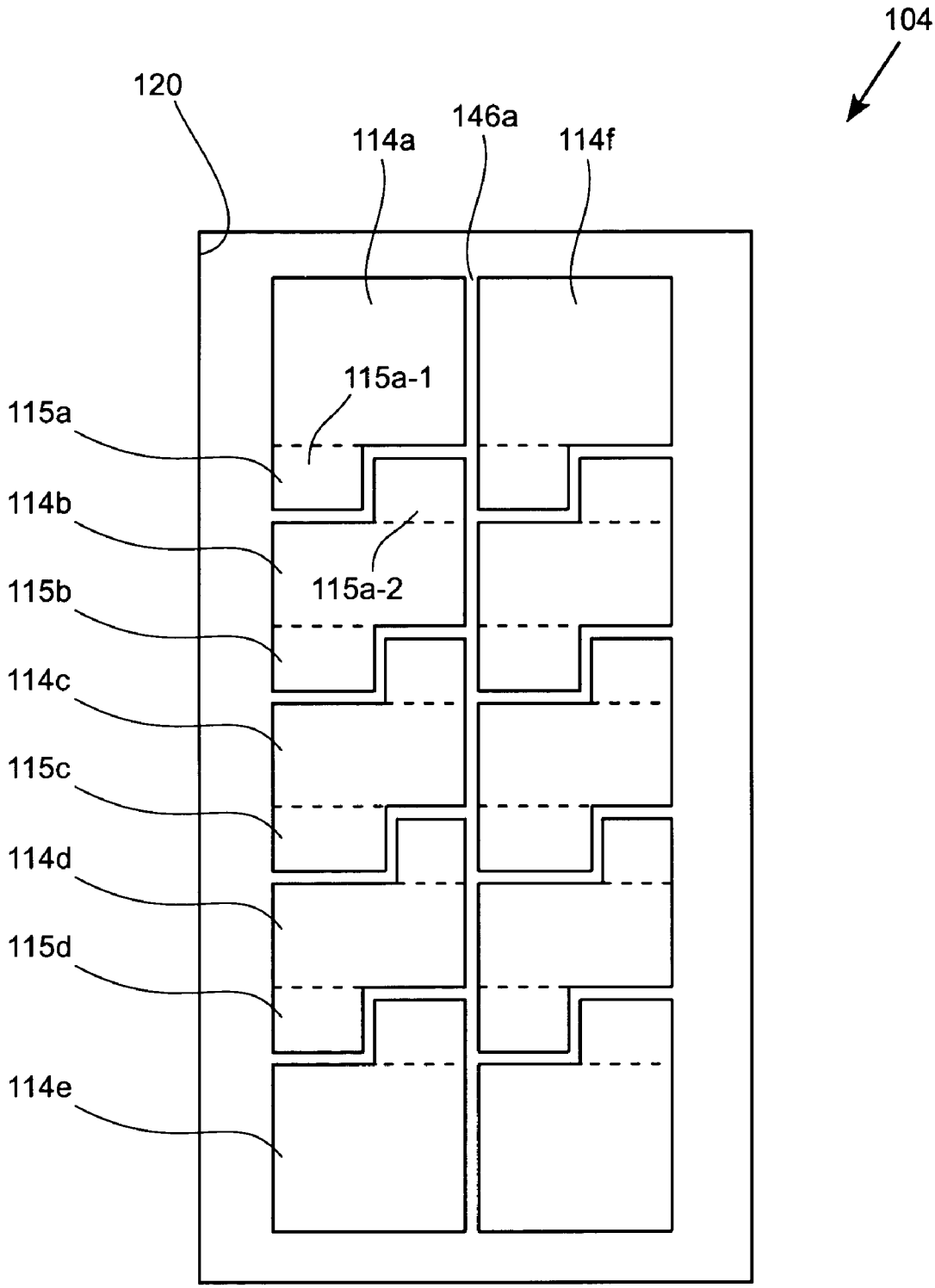
FIG. 3A is a simplified schematic top view diagram of the bottom transducer of FIG. 2B, illustrating a plurality of horizontally interlocking piezoelectric crystals, in accordance with another embodiment of the invention.

Implementing a plurality of interlocking piezoelectric crystals 114*a*–114*j* to eliminate dead zone band effects on wafer surfaces can be understood with respect to FIG. 3A, in accordance with one embodiment of the present invention. As can be seen, in the embodiment of FIG. 3A, the interlocking crystals 114*a*–114*j* are bonded to the bottom resonator 120 such that gap regions 146 are defined between the crystals 114*a*–114*j*. However, in accordance with the embodiments of the present invention, the interlocking crystals 114*a*–114*j* are defined in a horizontally staggered arrangement such that a corresponding overlapping region 115*a*–115*h* is defined between each pair of adjacent crystals 114*a*–114*b*, 114*b*–114*c*, 114*c*–114*d*, 114*d*–114*e*, 114*e* and 114*j*, 114*f*–114*g*, 114*g*–114*h*, 114*h*–114*i*, and 114*i*–114*j*.

In the embodiment of FIG. 3A, the gap regions 146 are defined to have an opposing L-shaped pattern. In this manner, dead energy zones created as a result of each gap region 146 are compensated by the adjacent crystal. In the exemplary embodiment shown in FIG. 3A, the overlapping region 15*a* created between crystals 114*a* and 114*b* has a substantially rectangular shape. Specifically, in this embodiment, the gap region 115*a* is composed of two adjacently defined rectangular-shaped sections 115*a*-1 and 115*a*-2, separated by the gap region 146. As can be appreciated, in this manner, acoustic energy imparted by the crystals 114*a* and 114*b* are averaged as a result of the overlapping region 115*a*, eliminating the dead energy zone bands created by the gaps 146. Furthermore, the area of each crystal making up the array is substantially the same, regardless of shape, so as to ensure matched impedance of each crystal.

In one example, the crystals 114*a*–114*j* are configured to have substantially equivalent surface area, thickness, and impedance. In accordance with preferred embodiments of the present invention, the gap region 146 is configured to be minimal. In one exemplary embodiment, the gap regions are configured to be from approximately about 4 mm and about 0.5 mm, and a more preferred range of approximately about 3 mm and 1 mm, and most preferably between approximately about 1 to about 2 millimeters. It must be appreciated by one having ordinary skill in the art that the gap region defined between pairs of adjacent crystals can be minimal so long as acoustic energy imparted by the adjacent crystals does not interfere with one another.

It must be appreciated that the piezoelectric crystals can be made of any appropriate piezoelectric material (e.g., piezoelectric ceramic, lead zirconium tintanate, piezoelectric quartz, gallium phosphate, etc.). In a like manner, the resonators can be made of any appropriate material (e.g., ceramic, silicon carbide, stainless steel, aluminum, quartz, etc.).

One having ordinary skill in the art must further appreciate that a thickness of the piezoelectric crystals 114*a*–114*j* depends on the design of the crystals, mechanical strength of the crystal material, and type of crystal material. In one example, the thickness of the crystals 114*a*–114*j* is configured to range between approximately about 1 mm and about 6 millimeter, and a more preferred range of approximately about 2 mm and 4 mm and most preferably between approximately about 1 mm to approximately about 2 millimeters. In one embodiment, wherein the crystals are ceramic type crystals, the thickness of the crystals is configured to range between approximately about 1 to about 4 millimeters.

In preferred embodiments, the top and bottom transducers 102 and 104 create pressure waves through sonic energy. The sonic energy is then transmitted through the corresponding top and bottom resonators 120' and 120 and imparted by the plurality of crystals 114*a*–114*j* defined on each of the top and bottom resonators 120' and 120 to the top and bottom surfaces of the wafer 108. As the crystals 114*a*–114*j* are staggered in the planer arrangement, the acoustic energy imparted by the crystals 114*a*–114*j* is averaged, eliminating the possibility of creating dead energy zones and the associated dead zone bands across the top and bottom surfaces of the wafer 108.

Figure 3B:
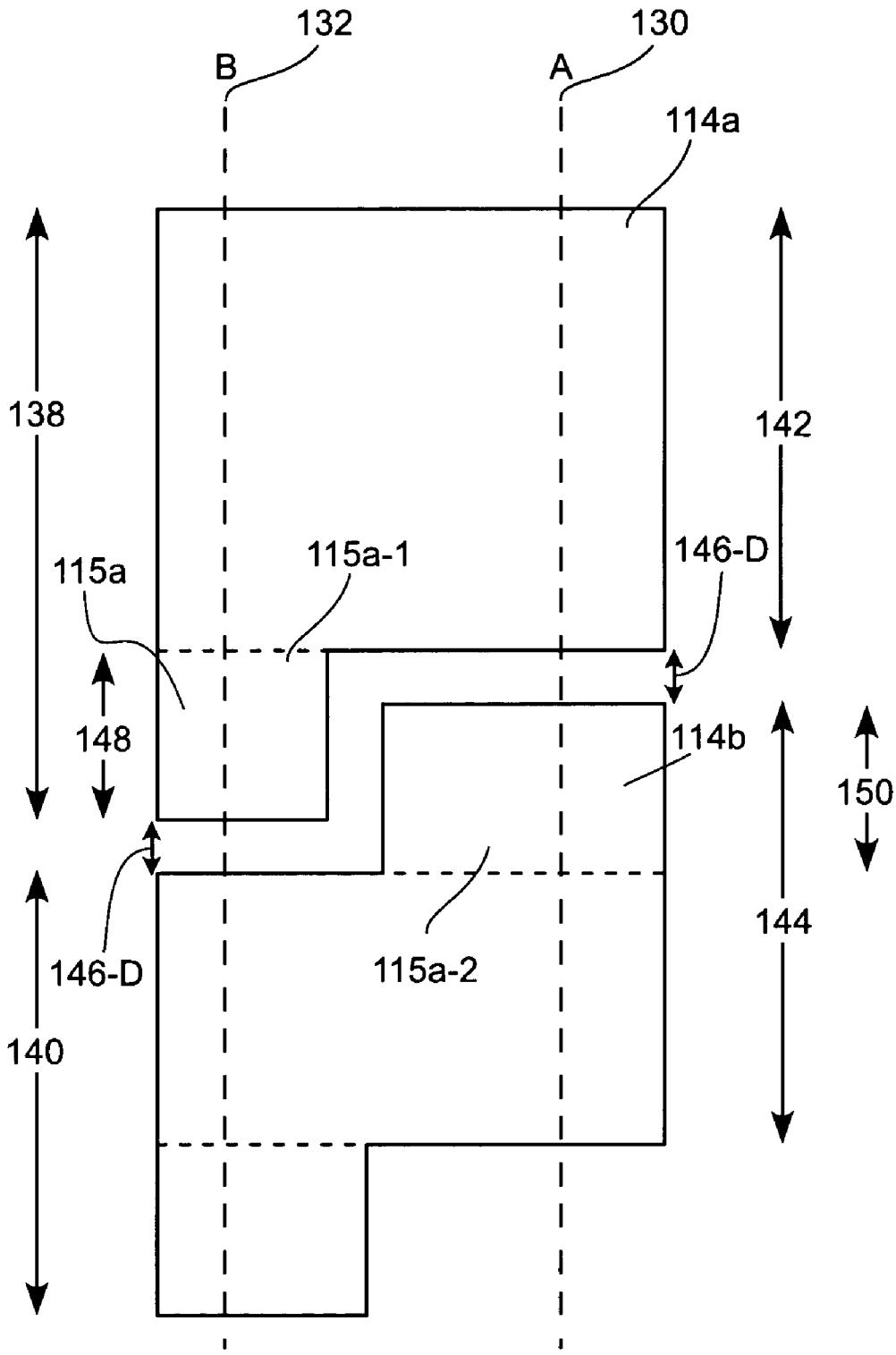
FIG. 3B is a simplified schematic top view diagram of two adjacent crystals of the plurality of horizontally interlocking piezoelectric crystals, in accordance with yet another embodiment of the invention.
Figure 3C:
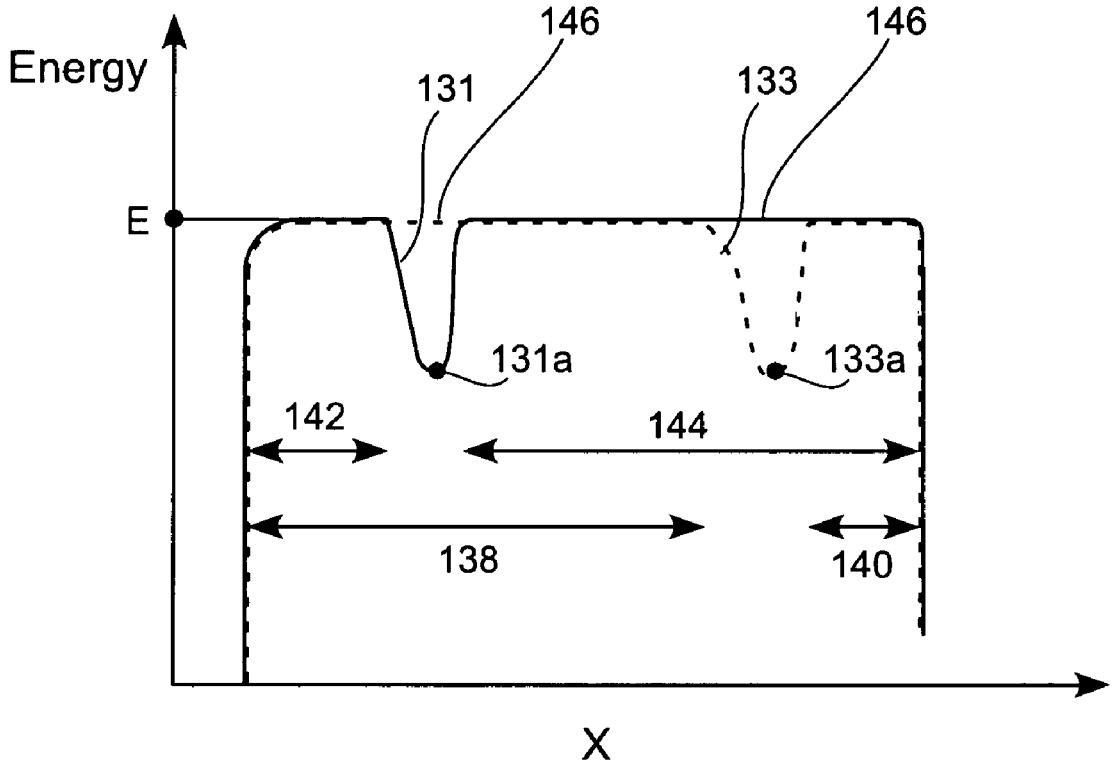
FIG. 3C depict energy versus distance graphs corresponding to viewing of two exemplary horizontally staggered crystals at exemplary lines, in accordance with still another embodiment of the invention.

FIG. 3B is an exploded simplified top view of two horizontally staggered crystals 114*a* and 114*b*, in accordance with one embodiment of the present invention. The overlapping region 115*a* is shown to include the section 115*a*-1 of the crystal 114*a*, the gap region 146, and the section 115*a*-2 of the crystal 114*b*. FIG. 3C is a plot of energy versus distance illustrating the capability of the embodiments of the present invention to average the acoustic energy imparted on the top and bottom surfaces of the wafer, in accordance with one embodiment of the present invention. As can be seen, FIG. 3C depicts two graphs 131 and 133, with each graph 131 and 133 representing the variation in the acoustic energy at the associated lines A 130 and B 132 of FIG. 3B.

Referring to FIG. 3C, plots 131 and 132 reveal variation in acoustic energy generated by the crystal 114*a* at lines A 130 and B 132, respectively, in the viewing direction 139. The plot 131 reveals an initial rise in the acoustic energy followed by a brief period during which the graph is shown to be substantially leveled. In one example, the substantially leveled portion of the graph corresponds to the distance 142 of the crystal 114*a*. Specifically, so long as crystal material exists, acoustic energy is generated. As illustrated, the plot 131 then plummets briefly followed by an almost instant rise leading to a substantially leveled path. The plummeting followed by the almost instantaneous rise in the acoustic energy corresponds with the gap 146 defined between distances 142 and 144. The sudden variation in energy is due to absence of the crystal material. A second smooth portion of the plot 131 is shown to continue until the plot 131 makes a sudden vertical plunge. The second smooth portion of the plot 131 corresponds to acoustic energy generated as a result of the crystal material of crystal 114*b*, defined by the distance 144 of the crystal 114*b*. The final fall of plot 131 is attributed to lack of presence of any crystal material.

Still referring to FIG. 3C, plot 133 is also shown to start with a rather fast rise followed by a substantially smooth and leveled path that corresponds to a distance 138 of crystal 114*a*. Then, rather abruptly, the plot 133 plummets followed by almost immediate rise leading to a second smooth path. The abrupt fall is attributed to the absence of crystal material, gap 146 defined between distances 142 and 144. The second smooth path is attributed to generation of acoustic energy resulting from the presence of crystal 114*b*, at distance 140.

A comparison of the two plots 131 and 133 reveals that when monitoring the variation in acoustic energy in the viewing direction 139 at lines A 130 and B 132, reduction in acoustic energy resulting from lack of presence of crystal material is almost always compensated. For instance, lack of presence of crystal material at gap 146 defined between distances 142 and 144, depicted as point 131*a*, is compensated by the presence of crystal as shown in a portion 115*a*-1 of crystal 114*a*, having a distance 148. In a like manner, reduction of acoustic energy resulting from gap 146 defined between distances 138 and 140 is compensated by a portion 115*a*-2 of crystal 114*b*, having a distance 150. In this manner, beneficially, variation in acoustic energy is substantially reduced and even eliminated.

Figure 3D:
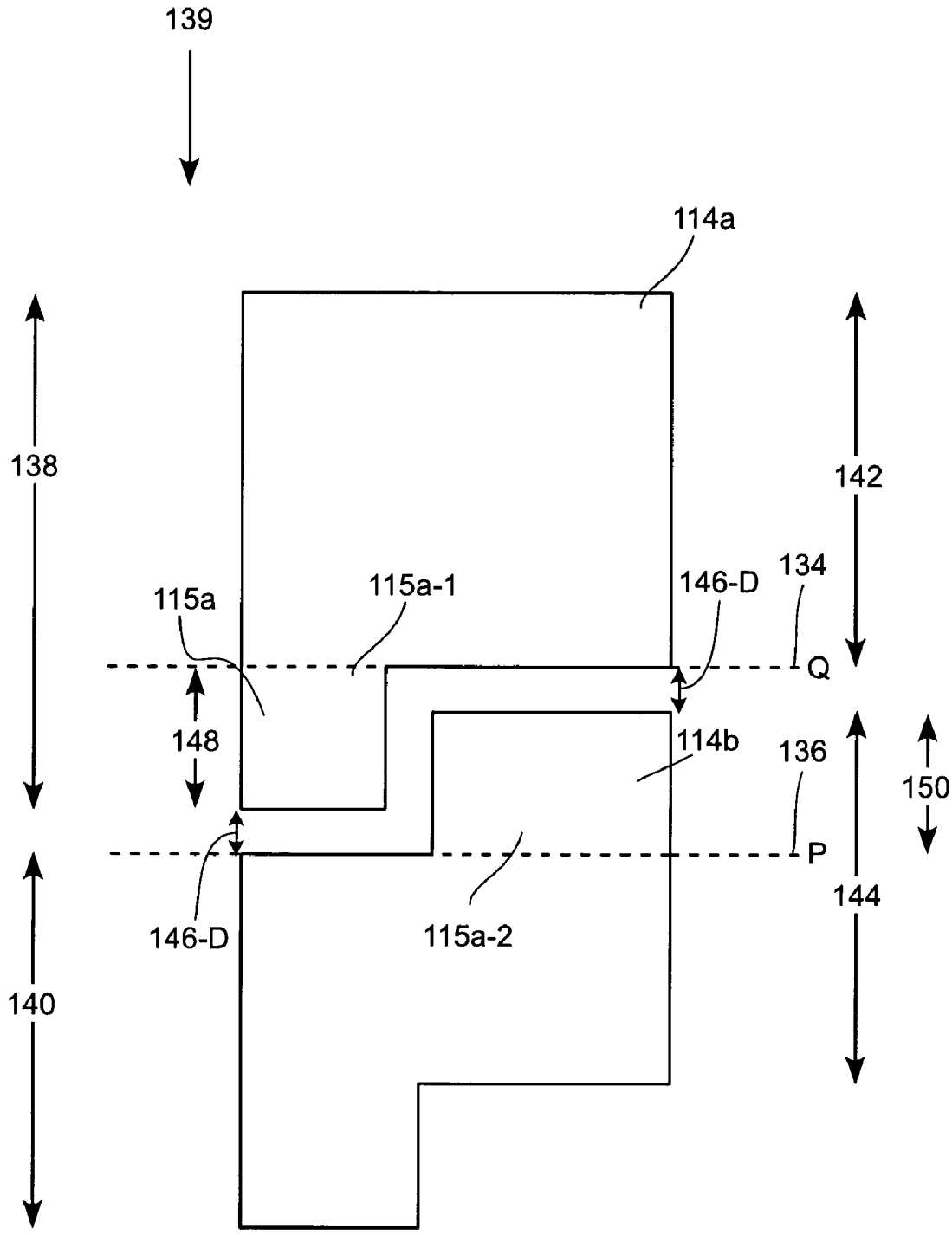
FIG. 3D is a simplified top view diagram of the two adjacent crystals of the plurality of horizontally interlocking piezoelectric crystals, in accordance with yet another embodiment of the invention.

FIG. 3D is an exploded simplified top view of the two horizontally staggered crystals 114*a* and 114*b* shown in FIG. 2B, in accordance with one embodiment of the present invention. As shown, the overlapping region 115*a* includes the section 115*a*-1 of the crystal 114*a*, the gap region 146, and the section 115*a*-2 of the crystal 114*b*. Line Q 134 denotes the upper portion of the overlapping region 115*a* while the line P 136 marks the lower portion of the overlapping region 115*a*.

Figure 3E:
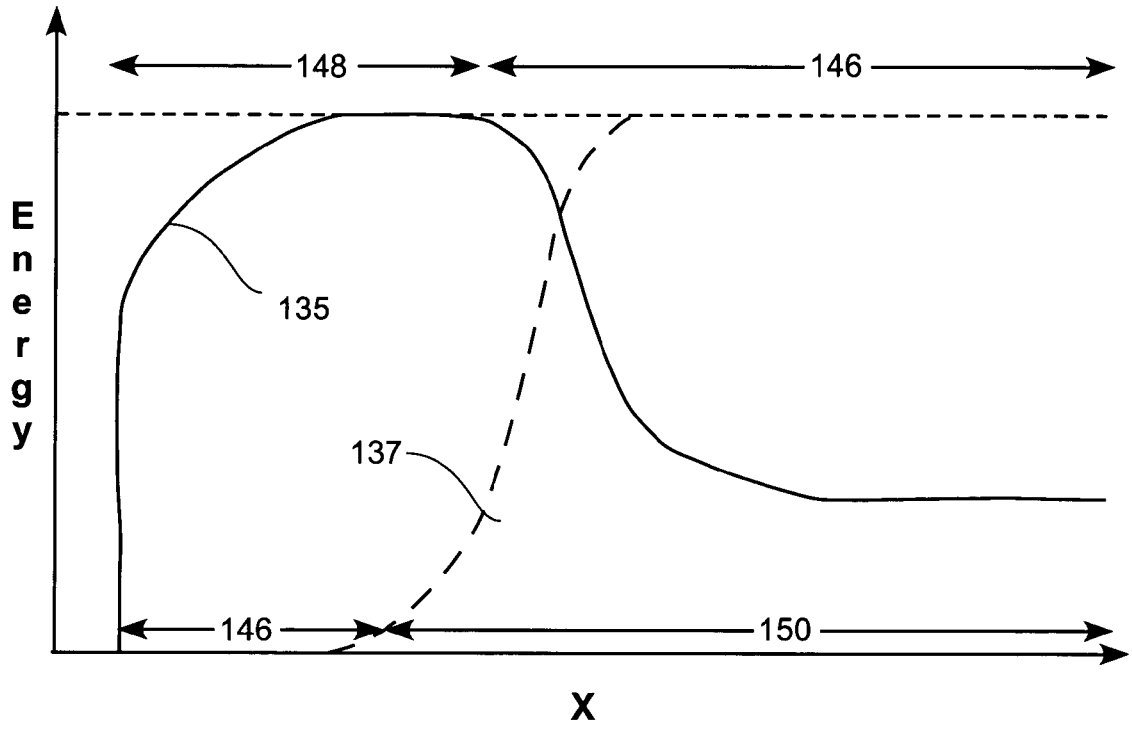
FIG. 3E depict energy versus distance graphs corresponding to viewing of two exemplary horizontally staggered crystals at exemplary lines, in accordance with still another embodiment of the invention.

FIG. 3E is a plot of energy versus distance, illustrating the capability of the embodiments of the present invention to average the acoustic energy imparted on the top and bottom surfaces of the wafer, in accordance with another embodiment of the present invention. The illustrated FIG. 3E depicts two graphs 135 and 137, each representing the variation in the acoustic energy in the overlapping region 115*a*, between the lines Q 130 and P 132 of FIG. 3D.

Referring to FIG. 3E, plots 135 and 137 reveal variation in acoustic energy generated by corresponding crystals 114*a* and 114*b*, in the overlapping region 115*a* defined between lines Q 134 and P 132, in the viewing direction 139. The plot 135 reveals an initial rise in the acoustic energy followed by a period during which the graph 135 is shown to be substantially leveled. In one embodiment, the rise in the acoustic energy is associated with the presence of crystal material in portion 115*a*-1 of the crystal 114*a*, having the distance 148. The subsequent fall is attributed to the absence of crystal material at gap 146, between distances 138 and 140. In comparison, the plot 137 is shown to start and remain at almost zero acoustic energy and continue at a smooth path for a period of time. Thereafter, the graph 137 is shown to suddenly rise to a point, subsequent to which a substantially leveled path is shown. The variation in graph 137 is explained as follows: The substantially smooth graph during which almost no acoustic energy is detected is associated with the gap 146 defined between distances 142 and 144. The sudden rise in the acoustic energy and the subsequent smooth path is due to detection of crystal material at the portion 115*a*-2 of the overlapping portion 115*a*-2.

In this manner, the embodiments of present invention compensate for absence of crystal material in the gaps by the overlapping portions of the adjacent crystals. In this manner, as the wafer rotates and the transducers scan the surfaces of the wafer, crystal material can be detected allowing the acoustic energy generated by the crystals to be substantially averaged.

Figure 4A:
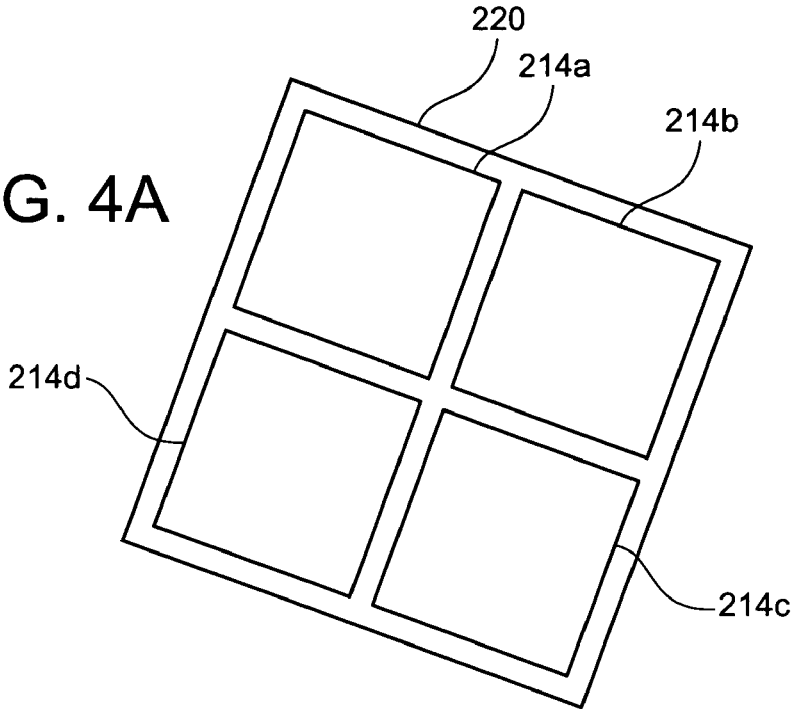
FIG. 4A depicts a simplified top view of four square-shaped crystals bonded to the resonator at an angle, in accordance with still another embodiment of the invention.

Reference is made to FIGS. 4A–4D illustrating several exemplary configurations for bonding horizontally staggered crystals to a resonator so as to achieve averaged acoustic energy, in accordance with several embodiments of the present invention. FIG. 4A, for instance, depicts bonding of four square-shaped crystals 214*a*–214*d* to the resonator 220 at an angle. As can be appreciated, the rotation of the wafer and the overlapping crystals eliminate any variation in acoustic energy, associated with the prior art. This occurs as dead zone banding is eliminated because gaps are compensated by the overlapping-crystals. Of course, as discussed above, the surface area, impedance, and width of the square-shaped crystals are equivalent.

Figure 4B:
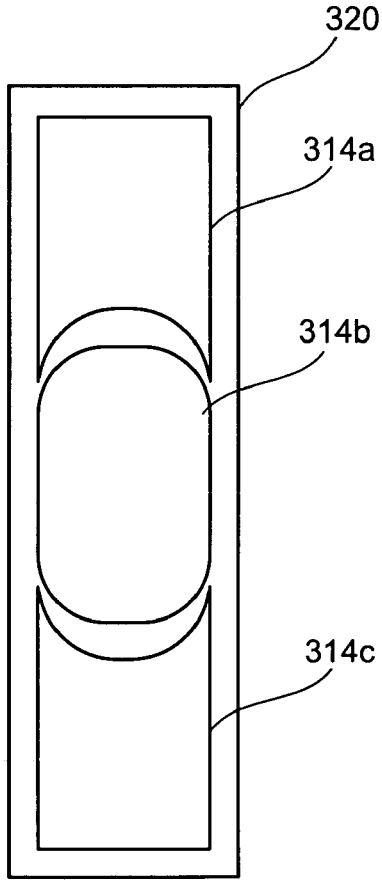
FIG. 4B is a simplified top view of three horizontally overlapping crystals being defined on a resonator, in accordance with still another embodiment of the invention.
Figure 4C:
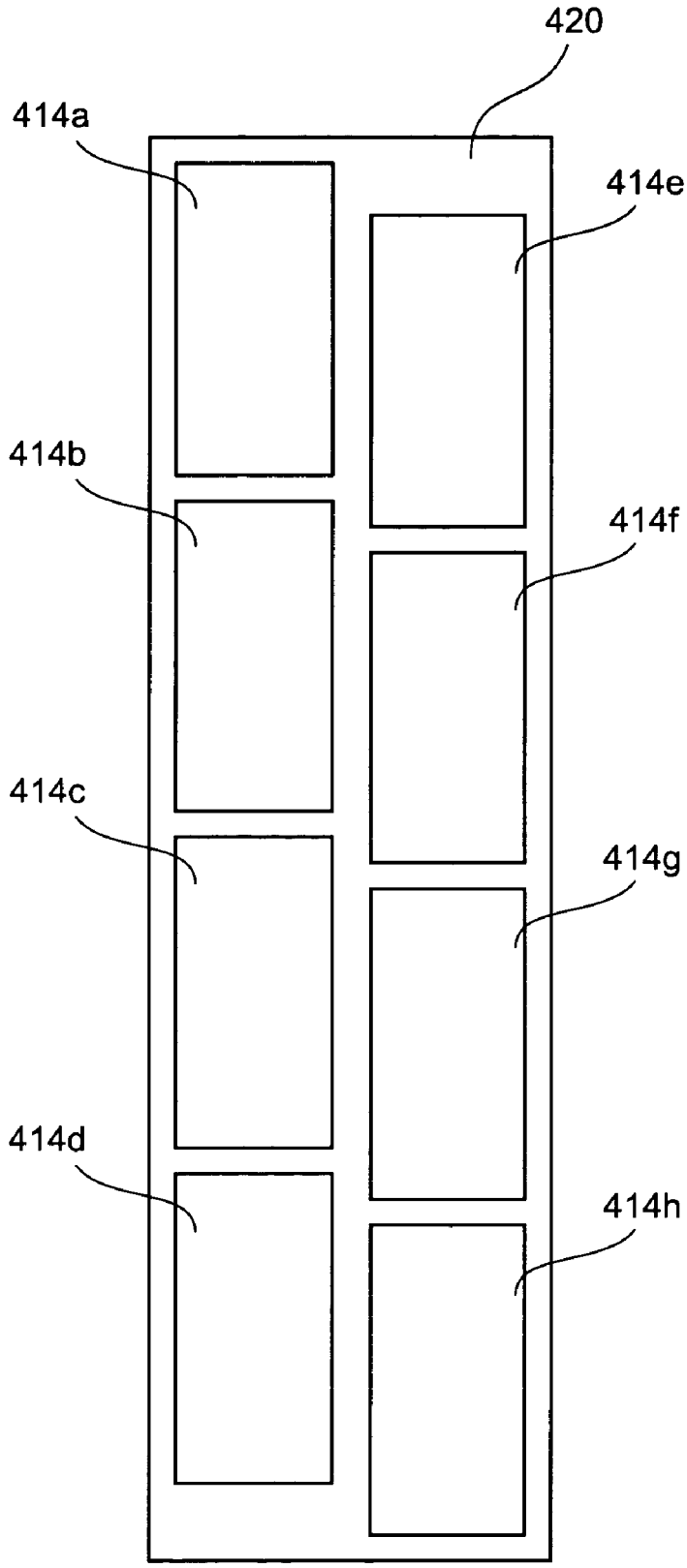
FIG. 4C is a simplified top view of a plurality of rectangular-shaped crystals being defined on a resonator such that each gap defined between crystals is compensated by at least one of the adjacent crystals, in accordance with yet another embodiment of the invention.

FIG. 4B illustrates a plurality of crystals 314*a*–314*c* being bonded to a resonator 320 such that the crystals 314*a*–314*c* horizontally overlap at least partially. In this manner, overlapping crystals beneficially allow averaging of the acoustic energy. Referring to FIG. 4C, a plurality of rectangular-shaped crystals 414*a*–414*h* are defined on the resonator 420 such that each gap defined between crystals is compensated by at least one of the adjacent crystals. Of course, crystals 314*a*–314*c* and crystals 414*a*–414*h* are defined such that the surface area, impedance, and width of the crystals are substantially equivalent. Furthermore, in one embodiment, crystals 414*a*–414*h* can define one array of crystals while in a different embodiment, crystals 414*a*–414*d* are configured to define one array of crystals and crystals 414*e*–414*h* are configured to define a second array of crystals. In any event, any combination of horizontally staggered crystals defining any number of crystal arrays can be implemented so long as at least partially overlapping regions exist between the crystals so as to allow the averaging of the acoustic energy. Furthermore, the crystals can be defined to have any appropriate shape so long as a horizontally overlapping region exists between the crystals so as to allow the averaging of the acoustic energy.

Figure 4D:
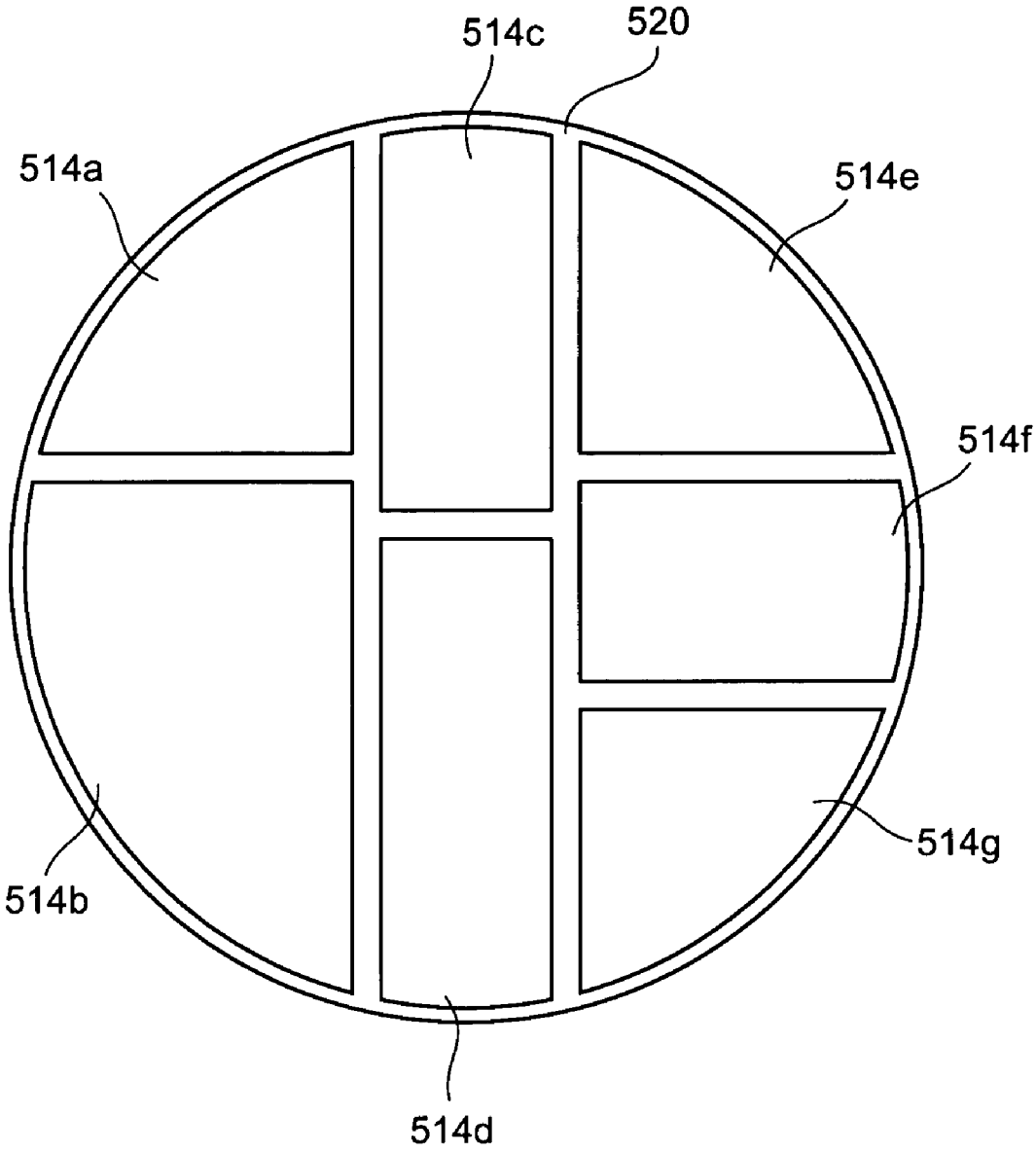
FIG. 4D is a simplified top view of a plurality of crystals having similar or dissimilar shapes being bonded to a resonator having a shape substantially similar to the shape of the semiconductor being cleaned, in accordance with still another embodiment of the invention.

In accordance with a different embodiment, as shown in FIG. 4D, a plurality of crystals, having similar or dissimilar shapes are bonded to a resonator 520 having a shape substantially similar to the shape of the semiconductor being cleaned, which in one embodiment is a circular shape. Depending on the embodiment, the wafer can be static or dynamic. For instance, the surface area of the resonator 520 can be defined to be smaller than the rotating wafer. In such implementation, the wafer is configured to be rotating so that the wafer surfaces can be scanned by the resonator 520. However, where the shape and surface area of the resonator 520 is substantially equivalent or larger than the wafer, the wafer can be static. In this manner, substantially the entire wafer surface is scanned by the resonator 520. Again, any shape of crystals can be implemented so long as at least a partially overlapping region exists between the crystals so as to allow the averaging of the acoustic energy.

Figure 5A:
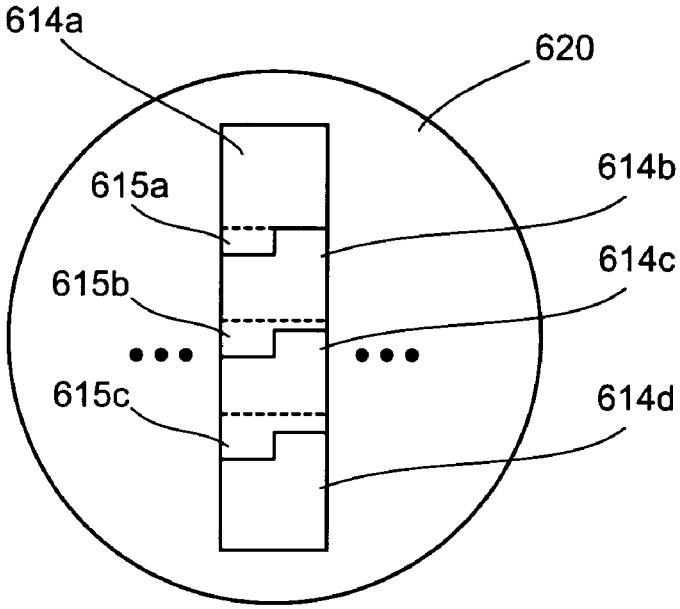
FIG. 5A is a simplified top view of a resonator bonded to a plurality of vertically staggered crystals, in accordance with one embodiment of the invention.

Reference is made to FIG. 5A illustrating a resonator 620 having a plurality of vertically staggered crystals 614*a*–614*d* bonded thereon, in accordance with one embodiment of the present invention. As shown, a respective vertically overlapping portion exits between each pair of adjacent crystals. For instance, crystals 614*a* and 614*b* have a vertically overlapping portion 615*a*, crystals 614*b* and 614*c* have a vertically overlapping portion 615*b*, and crystals 614*c* and 614*d* have a vertically overlapping portion 615*c*. The vertically overlapping crystals 614*a*–614*d* bonded to the resonator 620 are operated out of phase, ensuring that each and every portion of the surface of static wafer is exposed to the acoustic energy.

Figure 5B:
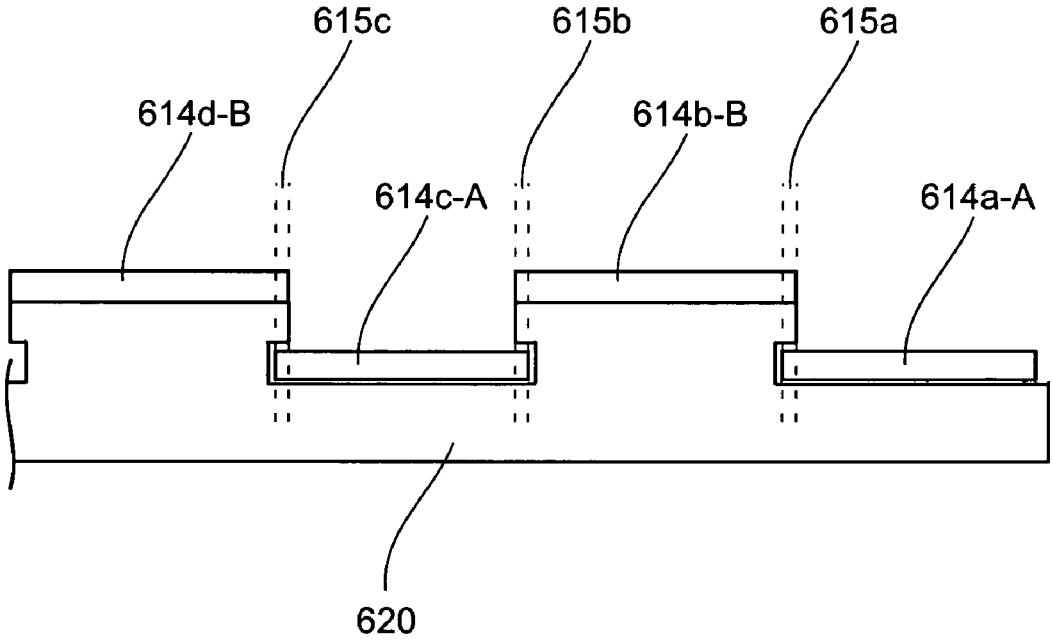
FIG. 5B is a simplified cross sectional view of the resonator of FIG. 5A showing a plurality of vertically overlapping portions between adjacent staggered crystals, in accordance with still another embodiment of the invention.

Implementing vertically staggered crystals 614*a*–614*d* bonded to the resonator 620 to scan the surface of the static wafer can further be understood with respect to the simplified, exploded, cross section view of the transducer shown in FIG. 5B, in accordance with one embodiment of the present invention. As can be seen, due to vertically overlapping nature of the portions 615*a*–615*c*, the crystals 614*a*–614*d* are designed to be powered in an out-of-phase manner. By way of example, crystals 614*a*-A and 614*c*-A are configured to be on at the same time while crystals 614*b*-B and 614*d*-B are off. After for instance, 10 milliseconds of response time, crystals 614*a*-A and 614*d*-B are turned off allowing the crystals 614*b*-B and 614*d*-B to be turned on. It must be appreciated by one having ordinary skilled in the art that the response time can be any appropriate length of time.

Figure 6:
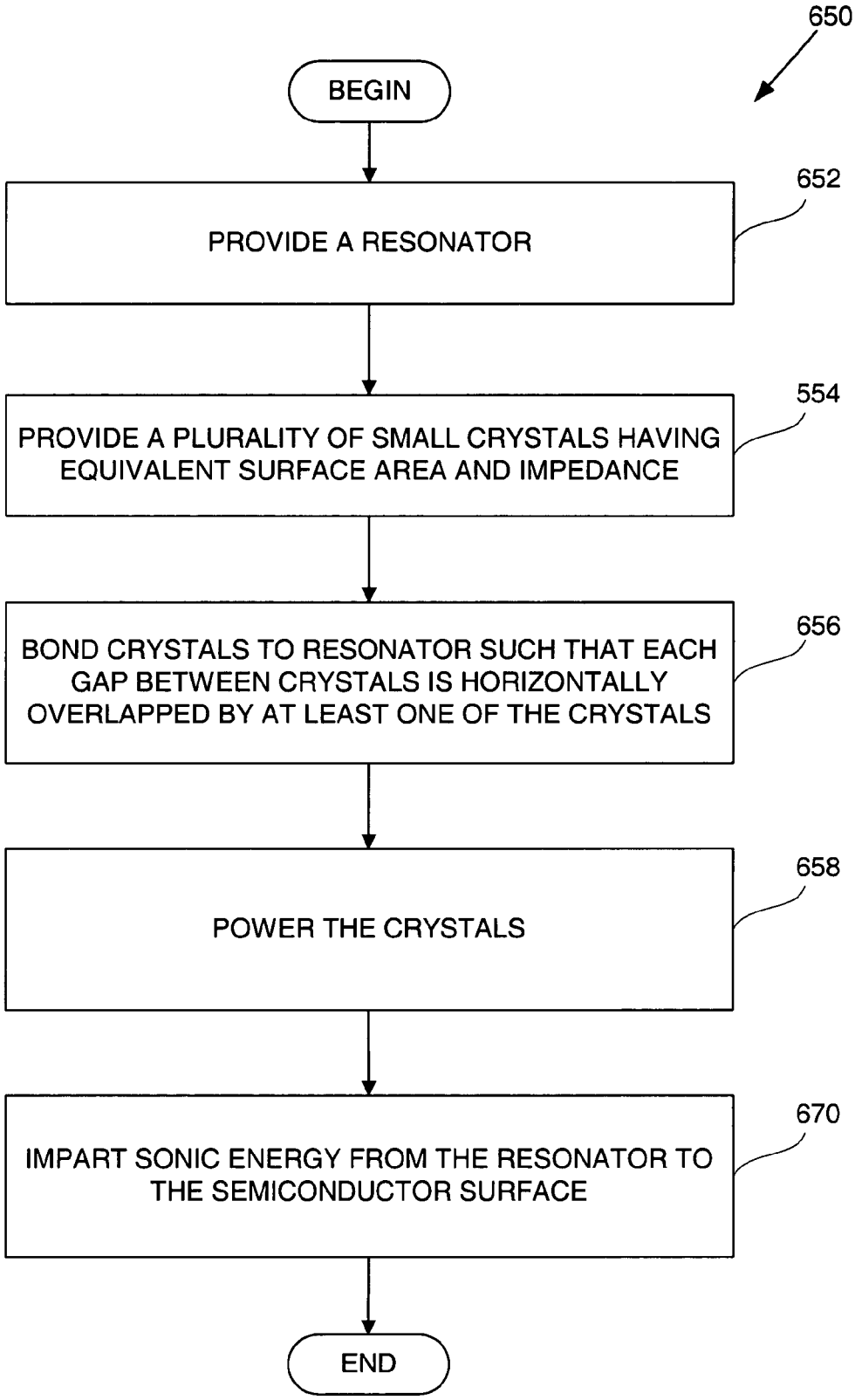
FIG. 6 is a flowchart diagram depicting method operations performed in a high frequency acoustic energy cleaner implementing an exemplary transducer including horizontally overlapped crystals, in accordance with still another embodiment of the present invention.

FIG. 6 depicts a flowchart diagram 650 of method operations performed in a high frequency acoustic energy cleaner implementing an exemplary transducer including horizontally overlapped crystals, in accordance with one embodiment of the present invention. The method begins in operation 652 in which a resonator is provided followed by operation 654 in which a plurality of small crystals is provided. The crystals are configured to have equivalent surface area and impedance. The method then advances to operation 656 in which the crystals are bonded to the resonator. The crystals are bonded such that each gap between crystals is horizontally overlapped by at least one of the remaining crystals. As discussed above, in this manner, the overlapping regions compensate for the gaps allowing uniform distribution of acoustic energy and thus uniform cleaning.

The method then proceeds to operation 658 in which the crystals are powered. As discussed above, the crystals are configured to be powered simultaneously. Next, in operation 670, sonic energy is imparted from the resonator to the semiconductor surface so as to clean the semiconductor surface.

Figure 7:
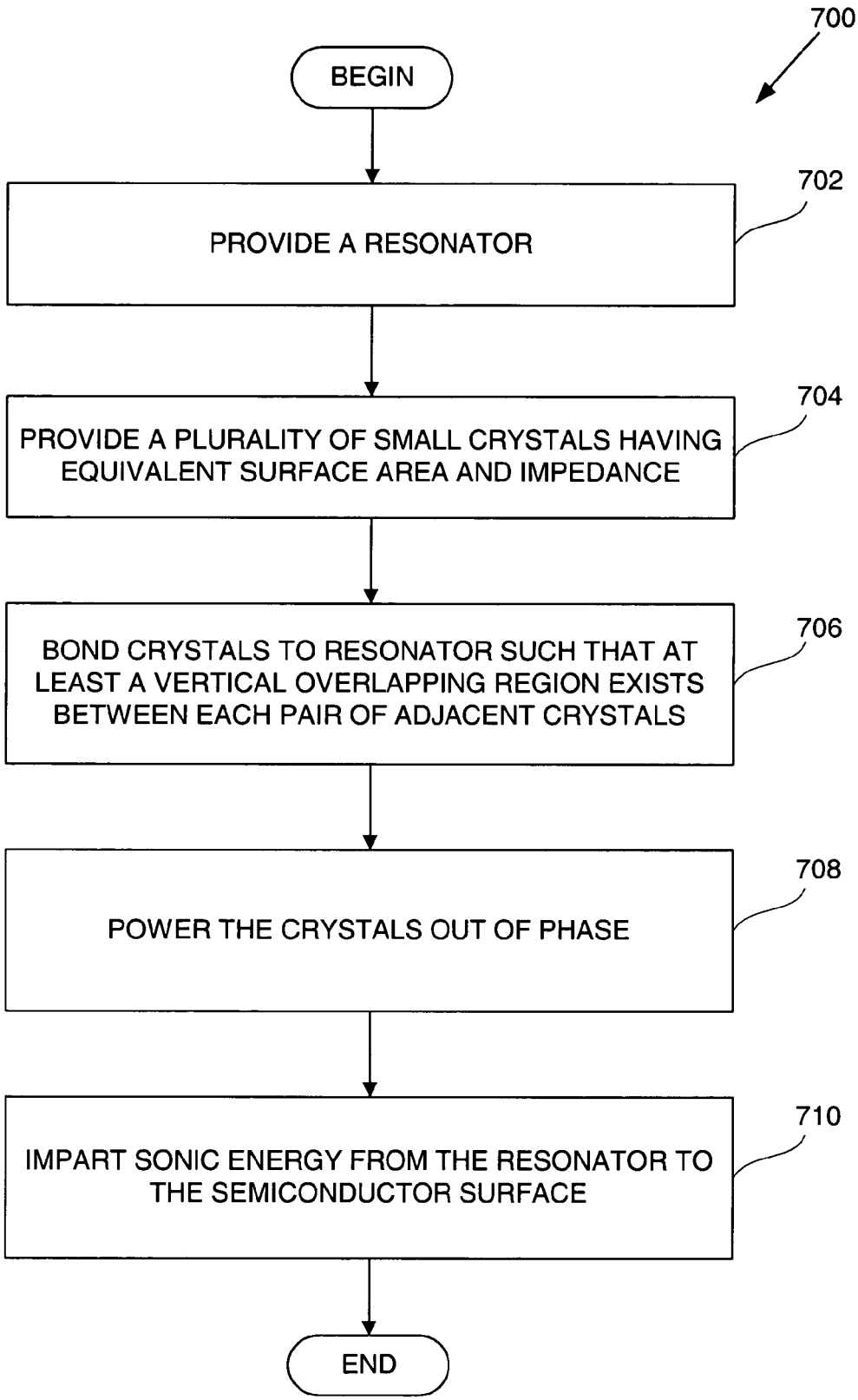
FIG. 7 depicts a flowchart diagram of method operations performed in a high frequency acoustic energy cleaner implementing an exemplary transducer including vertically overlapped crystals, in accordance with yet another embodiment of the present invention.

FIG. 7 depicts a flowchart diagram 650 of method operations performed in a high frequency acoustic energy cleaner implementing an exemplary transducer including vertically overlapped crystals, in accordance with one embodiment of the present invention. The method begins in operation 702 in which a resonator is provided followed by operation 704 in which a plurality of small crystals is provided. The crystals are configured to have equivalent surface area and impedance. The method then advances to operation 706 in which the crystals are bonded to the resonator. The crystals are bonded such that at least a vertically overlapping region exists between each pair of adjacent crystals. As discussed above, in this manner, the overlapping regions compensate for the gaps, allowing uniform distribution of acoustic energy.

The method then proceeds to operation 708 in which the crystals are powered out of phase. Next, in operation 710, sonic energy is imparted from the resonator the semiconductor surface. In one embodiment, the semiconductor substrate may be rotated during powering of the transducers.

It should be appreciated that the high frequency acoustic energy transducer of implementing vertically/horizontally-staggered crystals of the present invention is not limited to a CMP process. Additionally, although the embodiments described herein have been primarily directed toward cleaning semiconductor substrates, it should be understood that the high frequency acoustic energy cleaner of the present invention is well suited for cleaning any type of substrate. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims.

What is claimed is:

1. A transducer for use in an acoustic energy cleaner, the transducer comprising:

a resonator;

a plurality of crystals bonded to a surface of the resonator, the plurality of crystals configured to form an array of crystals, the plurality of crystals further configured to be bonded to the surface of the resonator in a horizontally staggered arrangement with respect to each other, wherein a gap region between a pair of adjacent crystals of the plurality of crystals is defined to have an opposing L-shaped pattern.

2. A transducer as recited in claim 1, wherein the pair of adjacent crystals of the plurality of crystals are separated by the gap region that is horizontal and defined to have an opposing L-shaped pattern when the plurality of crystals are horizontally staggered.

3. A transducer as recited in claim 1, wherein the plurality of crystals are powered substantially simultaneously.

4. A transducer as recited in claim 1, wherein the transducer is configured to scan a rotating semiconductor wafer.

5. A transducer as recited in claim 1, wherein the plurality of crystals are constructed from a piezoelectric material.

6. A transducer as recited in claim 1, wherein the horizontally staggered arrangement enables averaging of energy generated by the plurality of crystals.

7. An apparatus for cleaning a semiconductor substrate, the apparatus comprising:

a first transducer for propagating acoustic energy to a first surface of the semiconductor substrate, the first transducer including, a first resonator having a first surface and a second surface; and a plurality of crystals bonded to the first surface of the first resonator, the plurality of crystals configured to form an array of crystals, the plurality of crystals further configured to be bonded to the first surface of the first resonator in a horizontally staggered arrangement with respect to each other, wherein a gap region between a pair of adjacent crystals of the plurality of crystals is defined to have an opposing L-shaped pattern.

8. An apparatus as defined in claim 7, further comprising:

a second transducer for propagating acoustic energy to a second surface of the semiconductor substrate, the second transducer including, a second resonator having a first surface and a second surface; and a plurality of crystals bonded to the first surface of the second resonator, the plurality of crystals configured to form an array of crystals, the plurality of crystals further configured to be bonded to the first surface of the second resonator in a horizontally staggered arrangement with respect to each other, wherein a gap region between a pair of adjacent crystals of the plurality of crystals is defined to have an opposing L-shaped pattern.

9. An apparatus as recited in claim 7, wherein the pair of adjacent crystals of the plurality of crystals are separated by the gap region that is horizontal and defined to have an opposing L-shaped pattern when the plurality of crystals are horizontally staggered.

10. An apparatus as recited in claim 7, wherein the second surface of the first resonator faces a top surface of the semiconductor substrate.

11. An apparatus as recited in claim 8, wherein the second surface of the second resonator faces a bottom surface of the semiconductor substrate.

12. An apparatus as recited in claim 7, wherein the plurality of crystals are constructed from a piezoelectric material.

13. An apparatus for cleaning a semiconductor substrate, the apparatus comprising:

a first transducer for propagating acoustic energy to a first surface of the semiconductor substrate, the first transducer including, a first resonator having a first surface and a second surface; and a plurality of crystals bonded to the first surface of the first resonator, the plurality of crystals configured to form an array of crystals, the plurality of crystals further configured to be bonded to the first surface of the first resonator in a horizontally staggered arrangement with respect to each other, wherein a gap region between a pair of adjacent crystals of the plurality of crystals is defined to have an opposing L-shaped pattern;

a second transducer for propagating acoustic energy to a second surface of the semiconductor substrate, the second transducer including, a second resonator having a first surface and a second surface; and a plurality of crystals bonded to the first surface of the second resonator, the plurality of crystals configured to form an array of crystals, the plurality of crystals further configured to be bonded to the first surface of the second resonator in a horizontally staggered arrangement with respect to each other, wherein a gap region between a pair of adjacent crystals of the plurality of crystals is defined to have an opposing L-shaped pattern.

14. An apparatus as recited in claim 13, wherein the pair of adjacent crystals of the plurality of crystals are separated by the gap region that is horizontal and defined to have an opposing L-shaped pattern when the pair of adjacent crystals are horizontally staggered.

* * * * *